US006375502B2

(12) United States Patent
Yoshida et al.

(10) Patent No.: US 6,375,502 B2
(45) Date of Patent: Apr. 23, 2002

(54) CONNECTOR

(75) Inventors: Haruki Yoshida; Motohisa Kashiyama, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/725,193

(22) Filed: Nov. 29, 2000

(30) Foreign Application Priority Data

Nov. 29, 1999 (JP) ..... 11-337355

(51) Int. Cl.[7] ..... H01R 13/40
(52) U.S. Cl. ..... 439/595; 439/752
(58) Field of Search ..... 439/595, 752, 439/592, 598, 746, 748; 324/538, 66

(56) References Cited

U.S. PATENT DOCUMENTS 4,557,542 A * 12/1985 Coller et al. ..... 439/595
5,085,599 A * 2/1992 Maejima et al. ..... 439/595
5,512,833 A 4/1996 Fukuda et al. ..... 324/538
5,607,327 A * 3/1997 Tsuji et al. ..... 439/752
5,860,835 A * 1/1999 Ohsumi ..... 439/595

FOREIGN PATENT DOCUMENTS

JP 7-113836 5/1995

* cited by examiner

*Primary Examiner*—Hien Vu
(74) *Attorney, Agent, or Firm*—Sughrue Mion, PLLC

(57) ABSTRACT

A connector (1) includes connection terminals (2), and a connector housing (3) having terminal receiving chambers (15). A lance (22) and an elastic displacement-allowing space (24) are formed within the terminal receiving chamber (15). A groove (23) is formed in an upper partition wall (16) of the terminal receiving chamber (15) which is opposed to the connection terminal (2), and has the elastic displacement-allowing space (24) formed therein. A lance displacement detection pin (35) of a connector inspecting instrument (4) for detecting a half-insertion condition of the connection terminal (2), as well as a distal end portion (30) of the lance (22), can be inserted into and removed from the groove (23). The length of the distal end portion (30) of the lance (22) is determined in accordance with a depth of the groove (23).

13 Claims, 5 Drawing Sheets

1
2
3
4
5
6
9
11
15
22
23
30
31
32
33
34
35

CONNECTOR

BACKGROUND OF THE INVENTION

1. Field of the Invention

The present invention relates to a connector, comprising connection terminals and a connector housing having terminal receiving chambers. More particularly, the present invention relates to a connector in which a lance displacement detection pin of a connector inspecting instrument is inserted into the terminal receiving chamber so as to detect a half-insertion condition of the connection terminal.

The present application is based on Japanese Patent Application No. Hei. 11-337355, which is incorporated herein by reference.

2. Description of the Related Art

A connector, used for connecting vehicle's wire harnesses or the like together, comprises electrically-conductive connection terminals of a known construction, and a connector housing of a synthetic resin for receiving the connection terminals.

Terminal receiving chambers for respectively receiving the connection terminals are formed in the connector housing. The terminal receiving chambers extend through the connector housing from a front end surface thereof to a rear end surface thereof, and terminal insertion ports are formed in the rear end surface of the connector housing, and connection ports for respectively receiving mating connection terminals are formed in the front end surface of the connector housing.

A lance for retaining the connection terminal, received in the terminal receiving chamber, and an elastic displacement-allowing space for the lance are formed within each terminal receiving chamber. The lance has a tongue-like distal end portion, and a retaining projection for engagement with the connection terminal is formed on the distal end portion of the lance.

A lance displacement detection pin of a connector inspecting instrument is inserted into the elastic displacement-allowing space through the insertion port, formed in the front end surface, so as to detect a half-insertion condition of the connection terminal.

More specifically, in a half-insertion condition of the connection terminal, the lance is kept elastically deformed by the connection terminal (The lance is kept stranded on the connection terminal, with the retaining projection held in contact therewith). The distal end (the distal end portion and the retaining projection) of the lance is displaced with respect to the proper retaining position, and is disposed in the elastic displacement-allowing space. In this condition, when the lance displacement detection pin is inserted into the elastic displacement-allowing space, this pin abuts against the distal end portion of the lance, thereby detecting the half-insertion condition of the connection terminal.

In the above related example, the connector housing need to be so formed that the distal end of the lance can be displaced as much as possible so that the half-insertion condition of the connection terminal can be positively detected.

Therefore, it may be proposed to increase the height of projecting of the retaining projection on the lance. However, a terminal inserting force, required for inserting the connection terminal during an assembling operation, becomes too large, thus affecting the operation efficiency, and therefore this proposal has not served as an effective countermeasure.

SUMMARY OF THE INVENTION

With the above problem in view, it is an object of the present invention to provide a connector in which a distal end portion of a lance can be displaced as much as possible without increasing a terminal inserting force.

To achieve the above object, according to the first aspect of the present invention, there is provided a connector which comprises a connector housing including a terminal receiving chamber into which a connection terminal is insertable, the terminal receiving chamber having a displacement-allowing space, a lance formed in the terminal receiving chamber, the lance having a distal end portion which extends in an inserting direction of the connection terminal, wherein the connection terminal is inserted into the terminal receiving chamber while pushing the lance to enter the distal end portion thereof into the displacement-allowing space, and is retained by the lance in a complete insertion state thereof to be prevented from moving in a withdrawing direction opposite to the inserting direction, and a groove extending in the inserting direction of the connection terminal, the groove being formed in a wall of the terminal receiving chamber which is opposed to the connection terminal, and has the displacement-allowing space formed therein, wherein the distal end portion of the lance enters the groove in accordance with insertion of the connection terminal, and wherein length of the distal end portion of the lance is determined in accordance with a depth of the groove.

Preferably, the lance may be formed in a cantilever manner with respect to the connector housing to be elastically deformable.

In the present invention, the groove, into which the distal end portion of the lance can be inserted, is formed in the wall of the terminal receiving chamber toward which the distal end portion of the elastically-deformed lance moves, that is, the wall to which the received connection terminal is opposed through the displacement allowing space disposed therebetween. The length of the distal end portion of the lance is determined in accordance with a depth of the groove.

With this construction, when the connection terminal is received in the terminal receiving chamber in the connector housing, so that the lance is elastically deformed by the connection terminal, the amount of displacement of the distal end portion of the lance is larger as compared with the related construction. In a half-insertion condition of the connection terminal, also, the amount of displacement of the distal end portion of the lance is larger.

A lance displacement detection pin of a connector inspecting instrument for detecting a half-insertion condition of the connection terminal can be inserted into the groove, and therefore a half-insertion condition of the connection terminal can be positively detected.

The lance may have a retaining projection which engages the connection terminal to be retained in the terminal receiving chamber. In this case, the distal end portion of the lance is projected from the retaining projection so as to enter the groove in accordance with insertion of the connection terminal. However, it should be noted that the connector of the present invention is not so designed that the projecting height of the retaining projection on the lance is greater. Accordingly, a terminal inserting force, required for inserting the connection terminal during the assembling operation, is not large.

With respect to the groove, the wall of the terminal receiving chamber may be formed stepwise to thereby form the groove therein. With respect to the wall in which the groove is formed, it may be one of walls of the terminal receiving chamber which define the displacement-allowing space. With respect to the location of the displacement-allowing space, it may be disposed forwardly of a proximal end portion of the lance in the inserting direction of the connection terminal.

According to the second aspect of the present invention, it is preferable that the groove extends from an insertion port for the lance displacement detection pin to a vicinity of a portion of the wall with which the proximal end portion of the lance is integrally formed. In this case, the elastic deformation of the lance is not influenced by the groove. In other words, the force of retaining of the connection terminal by the lance is not lowered by the groove. Similar to the first aspect of the present invention, a terminal inserting force, required for inserting the connection terminal during the assembling operation, is not large.

According to the third aspect of the present invention, it is preferable that a width of the groove in a direction perpendicular to the inserting direction of the connection terminal is smaller than a width of the displacement-allowing space in the same direction as the width of the groove. In this case, the structure is not complicated. And besides, the terminal inserting force, required for inserting the connection terminal during the assembling operation, as well as the force of retaining of the connection terminal by the lance, is not affected.

DETAILED DESCRIPTION OF THE PREFERRED EMBODIMENT

Hereinafter, one preferred embodiment of the present invention now will be described with reference to FIGS. 1 to 5.

Figure 1:
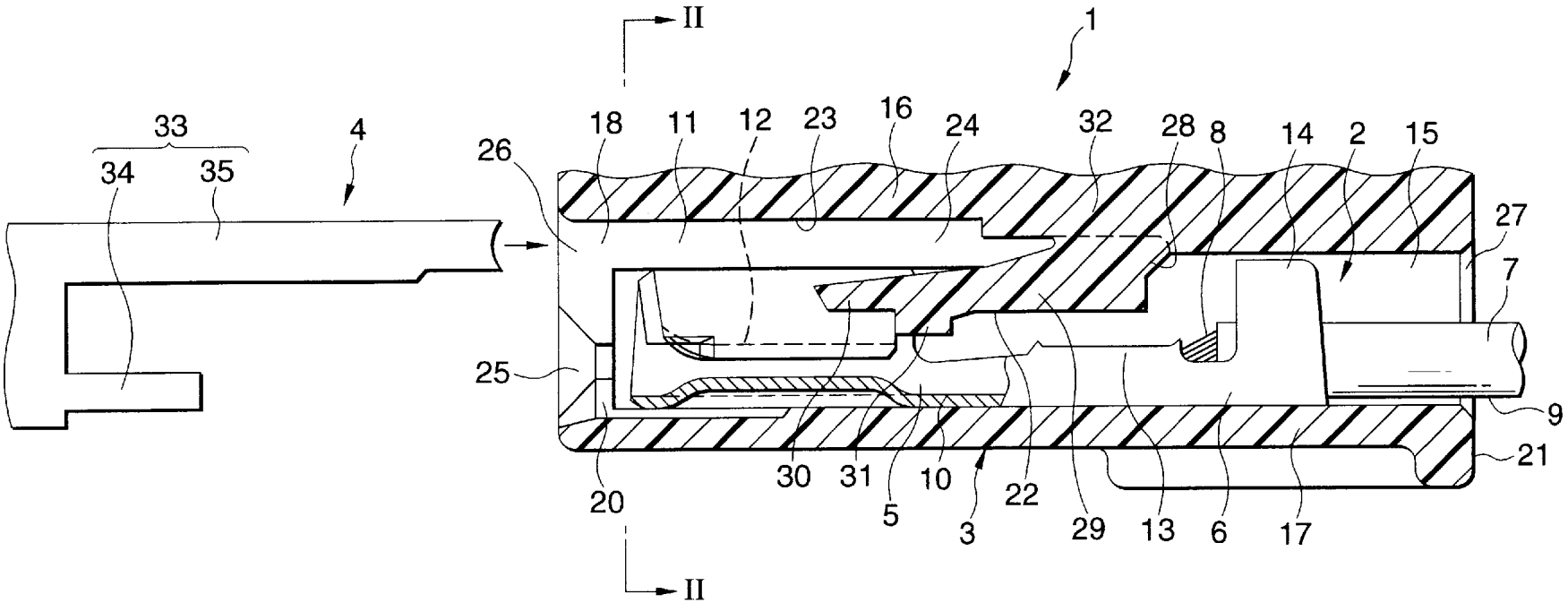
FIG. 1 is a cross-sectional view of one preferred embodiment of a connector of the present invention.
Figure 2:
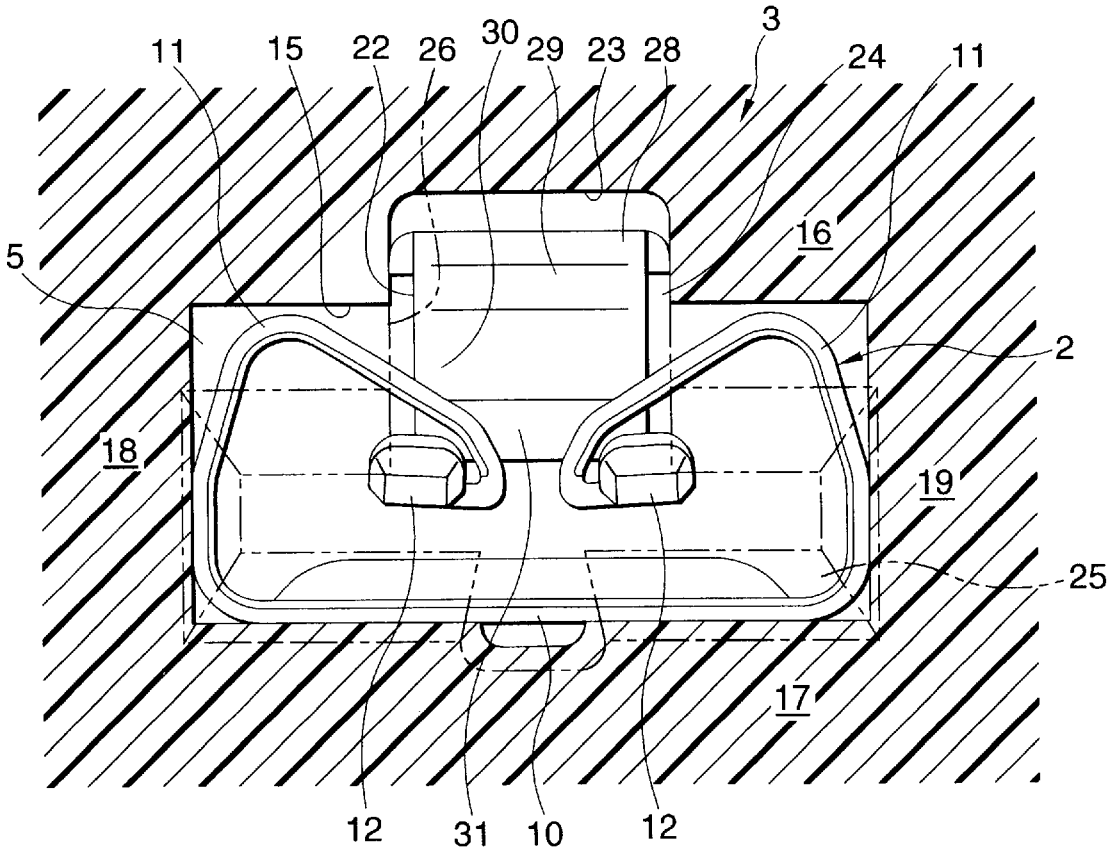
FIG. 2 is a cross-sectional view taken along the line II—II of FIG. 1.

FIGS. 1 and 2 show a connector 1 used for connecting vehicle's wire harnesses or the like together.

The connector 1 comprises a plurality of connection terminals 2 (only one of which is shown), and a connector housing 3 for receiving the plurality of connection terminals 2. The connector 1 is so constructed that a half-insertion condition can be positively detected by the connector inspecting instrument 4.

The above constituent members now will be described in detail.

The connection terminal 2 is formed by pressing an electrically-conductive metal sheet, and this connection terminal includes an electrical contact portion 5 and a wire connection portion 6. A wire 9, in which a sheath 7 is removed from an end portion of the wire to thereby expose a conductor 8, is secured by pressing to the connection terminal 2.

The electrical contact portion 5 includes a base plate portion 10, a pair of resilient curl portions 11 and 11, and a pair of electrical contact piece portions 12 and 12 extending respectively from the resilient curl portions 11 and 11 and bent slightly obliquely upwardly at a small angle relative to the curl portions 11 and 11, respectively. A mating connection terminal (not shown) in the form of a male tab-like terminal can be inserted into the electrical contact portion 5 to be connected thereto.

The wire connection portion 6 is formed in continuous relation to the electric contact portion 5, and includes conductor clamping portions 13 and 13 (only one of which is shown) for holding the conductor 8, and sheath clamping portions 14 and 14 (only one of which is shown) for holding the sheath 7. By compressively deforming the conductor clamping portions 13 and 13 and the sheath clamping portions 14 and 14 by pressing, the wire 9 is secured to the connection terminal 2.

The connector housing 3 is molded into a rectangular box-shape, using a synthetic resin. The connector housing 3 has a plurality of terminal receiving chambers 15 (only one of which is shown) for respectively receiving the plurality of connection terminals 2.

Each of the terminal receiving chamber 15 extends through the connector housing 3 from a front side thereof to a rear side thereof, and is defined by an upper partition wall 16, a lower partition wall 17, a right partition wall 18 and a left partition wall 19 (see FIG. 2).

A lance 22, a groove 23 and an elastic displacement-allowing space 24 are formed within the terminal receiving chamber 15.

Connection ports 25 and detection pin insertion ports 26 are formed in a front wall 20 of the connector housing 3 which forms part of the terminal receiving chambers 15. Terminal insertion ports 27, communicating respectively with the terminal receiving chambers 15, are formed in a rear end 21 of the connector housing 3. The connection ports 25, as well as the detection pin insertion ports 26, communicate with the terminal receiving chambers 15, respectively.

The upper partition wall 16 is formed by an upper wall of the connector housing 3 or the lower partition wall 17 of other terminal receiving chamber 15. The lower partition wall 17 is formed by a lower wall of the connector housing 3 or the upper partition wall 16 of other terminal receiving chamber 15. The left partition wall 18 and the right partition wall 19 are formed respectively by a left wall and a right wall of the connector housing 3, or by the right partition wall 19 of other terminal receiving chamber 15 and the left partition wall 18 of other terminal receiving chamber 15, respectively.

The upper partition wall 16 is opposed to the pair of resilient curl portions 11 and 11 of the connection terminal 2 received in the terminal receiving chamber.

The lance 22 has elasticity, and has a cantilever arm-like shape defined by a proximal end portion 28, an intermediate portion 29 and a distal end portion 30. A retaining projection 31 is formed on the lance 22 generally at the boundary between the intermediate portion 29 and the distal end portion 30.

The distal end portion 30 of the lance 22 extends in a direction of insertion of the connection terminal 2, and when the connection terminal 2 is completely received in the terminal receiving chamber 15, the retaining projection 31 is engaged with the connection terminal 2 to prevent the connection terminal 2 from moving in a withdrawing direction opposite to the direction of insertion of the connection terminal 2.

The proximal end portion 28 is formed integrally on a lance-forming portion 32 disposed at an intermediate portion of the upper partition wall 16. This proximal end portion 28 projects downwardly a small distance from the lance-forming portion 32.

The intermediate portion 29 extends from a projecting distal end of the proximal end portion 28 in the direction of insertion of the connection terminal 2. The intermediate portion 29 is slightly tapering (that is, decreasing in transverse cross-sectional area) progressively toward its distal end.

The distal end portion 30 is formed into a tongue-like shape, and an upper edge or corner of this distal end portion 30, disposed close to the upper partition wall 16, is formed into an acute angle as seen from its cross-sectional view. Thanks to the provision of the groove 23, the distal end portion 30 has a larger length (determined in accordance with the depth of the groove 23) as compared with the related construction. Thus, the distal end portion 30 is larger in length as compared with the related construction, and therefore when the lance 22 is elastically deformed by the connection terminal 2, the amount of displacement of the distal end portion 30 is larger as compared with the related construction.

The retaining projection 31 can engage the rear ends of the pair of resilient curl portions 11 and 11. When the lance 22 is bent (elastically deformed) in a half-insertion condition of the connection terminal, the retaining projection 31 rides on those surfaces of the pair of resilient curl portions 11 and 11 facing the upper partition wall 16.

The groove 23 is formed in the upper partition wall 16, and the distal end portion 30 of the lance 22, elastically deformed by the connection terminal 2, is inserted in this groove 23. The groove 23 extends in the direction of insertion of the connection terminal 2, and the lance displacement detection pin 35 of the connector inspecting instrument 4 (described later) can be inserted into and removed from this groove 23. The groove 23 is recessed slightly with respect to the lance-forming portion 32 so as not to affect the elastic deformation of the lance 22.

The depth of the groove 23 is determined in accordance with the length of the distal end portion 30 of the lance 22. The width of the groove 23 (that is, its dimension in a direction perpendicular to the terminal-inserting direction and the direction of the depth of this groove) is so determined that at least the distal end portion 30 of the lance 22 can be inserted into the groove 23.

In this embodiment, the width of the groove 23 is smaller than the width of the elastic displacement-allowing space 24. Part of the detection pin insertion port 26 is formed into a shape corresponding to the cross-sectional shape of the groove 23 (The structure is simplified).

The elastic displacement-allowing space 24 is disposed forwardly of the proximal end portion 28 of the lance 22 in the inserting direction, and allows the elastic displacement of the lance 22. The elastic displacement-allowing space 24 is formed over a region from the groove 23 to the pair of resilient curl portions 11 and 11.

The connector inspecting instrument 4 includes a plurality of inspection pin portions 33 (corresponding in number to the connection terminals 2 and also to the terminal receiving chambers 15). The inspection pin portion 33 has an electrical contact pin 34 and the lance displacement detection pin 35. The electrical contact pin 34, when inserted into the terminal receiving chamber 15, contacts the electrical contact portion 5 of the connection terminal 2, and the lance displacement detection pin 35 can abut against the lance 22 in a half-insertion condition of the connection terminal.

In this embodiment, a half-insertion condition of the connection terminal 2 can be detected by the use of the connector inspecting instrument 4 of a known construction (disclosed, for example, in Unexamined Japanese Patent Publication No. Hei. 7-113836). Therefore, the showing of this connector inspecting instrument is simplified in the drawings. The electrical contact pin 34 and the lance displacement detection pin 35 are not electrically connected to each other.

Next, the process of assembling the connector 1 of the above construction, as well as the operation thereof, will be described.

Figure 3:
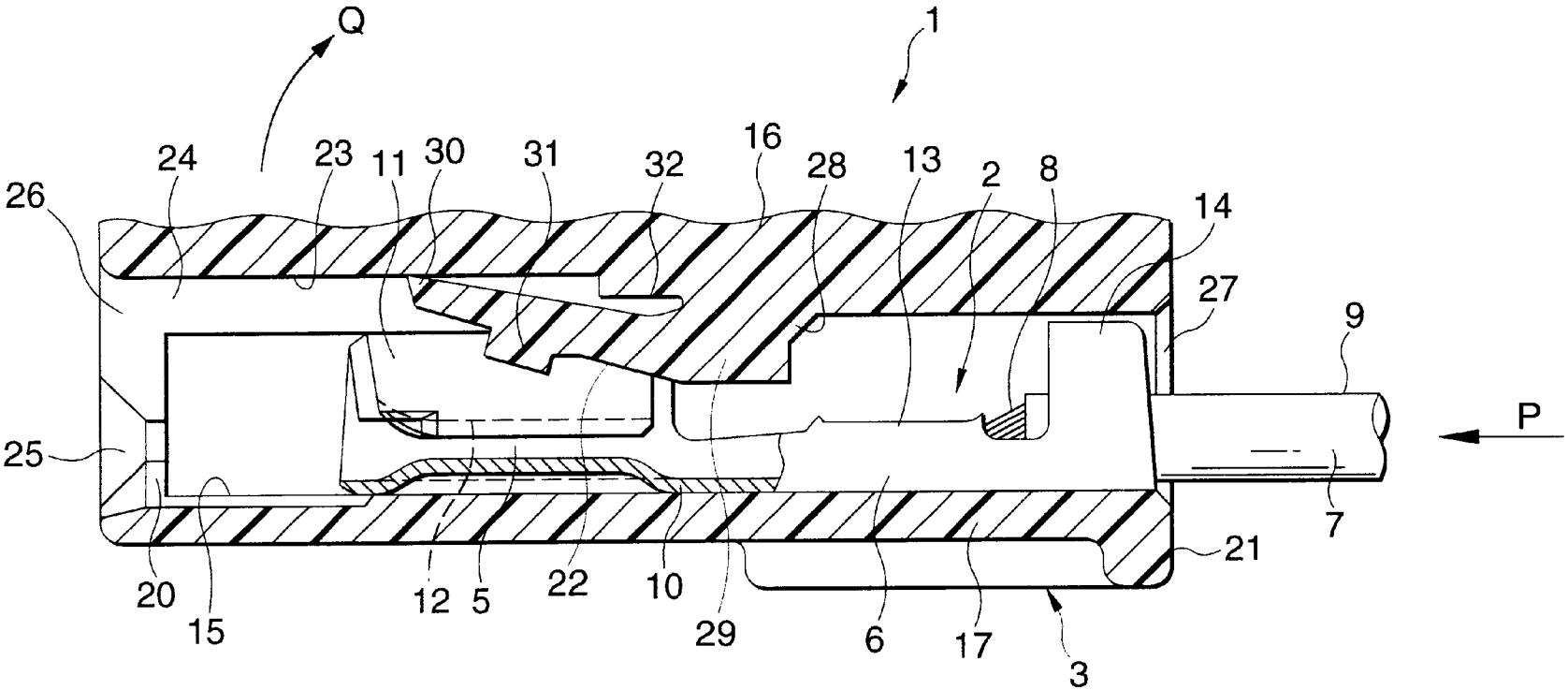
FIG. 3 is a cross-sectional view of the connector, showing a connection terminal in a half-insertion condition.

In FIG. 3, the connection terminals 2 are inserted respectively into the terminal receiving chambers 15 in the connector housing 3 to be received respectively in these chambers, thereby assembling the connector 1. More specifically, the connection terminal 2 is inserted through the terminal insertion port 27 in a direction of arrow P (that is, the above inserting direction), and is retainingly engaged with the lance 22, thus completing the inserting and receiving operation. This operation is effected for each connection terminal 2, and by doing so, the sequential connector-assembling operation is completed (see FIG. 1 also).

When the connection terminal 2 is inserted into the terminal receiving chamber 15, the electrical contact portion 5 of the connection terminal 2 is brought into engagement with the lance 22, so that the lance 22 is elastically deformed (in a direction of arrow Q) in the elastic displacement-allowing space 24. At this time, the distal end portion 30 of the elastically-deformed lance 22 is inserted into the groove 23. Also, the retaining projection 31 rides on the pair of resilient curl portions 11 and 11. Then, when the connection terminal 2 is further pushed to be inserted, the lance 22 is restored into its original condition as shown in FIG. 1, the retaining projection 31, riding on the curl portions 11 and 11, becomes engaged with the rear ends of these curl portions 11 and 11. As a result, the connection terminal 2 is retained, and therefore is prevented from moving in a withdrawing direction (opposite to the direction of arrow P).

Figure 4B:
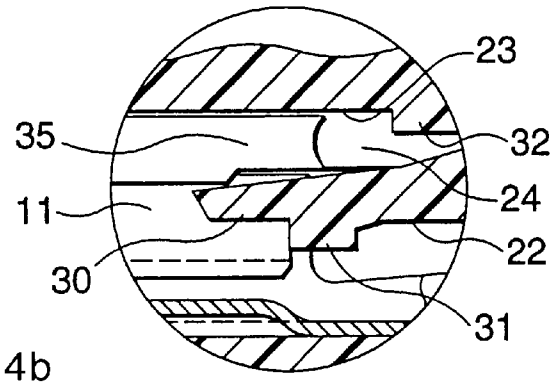
FIGS. 4*a* and 4*b* are cross-sectional views of the connector, showing a condition in which the connection terminal is completely inserted, and an inspection by a connector inspecting instrument is effected.
Figure 4A:
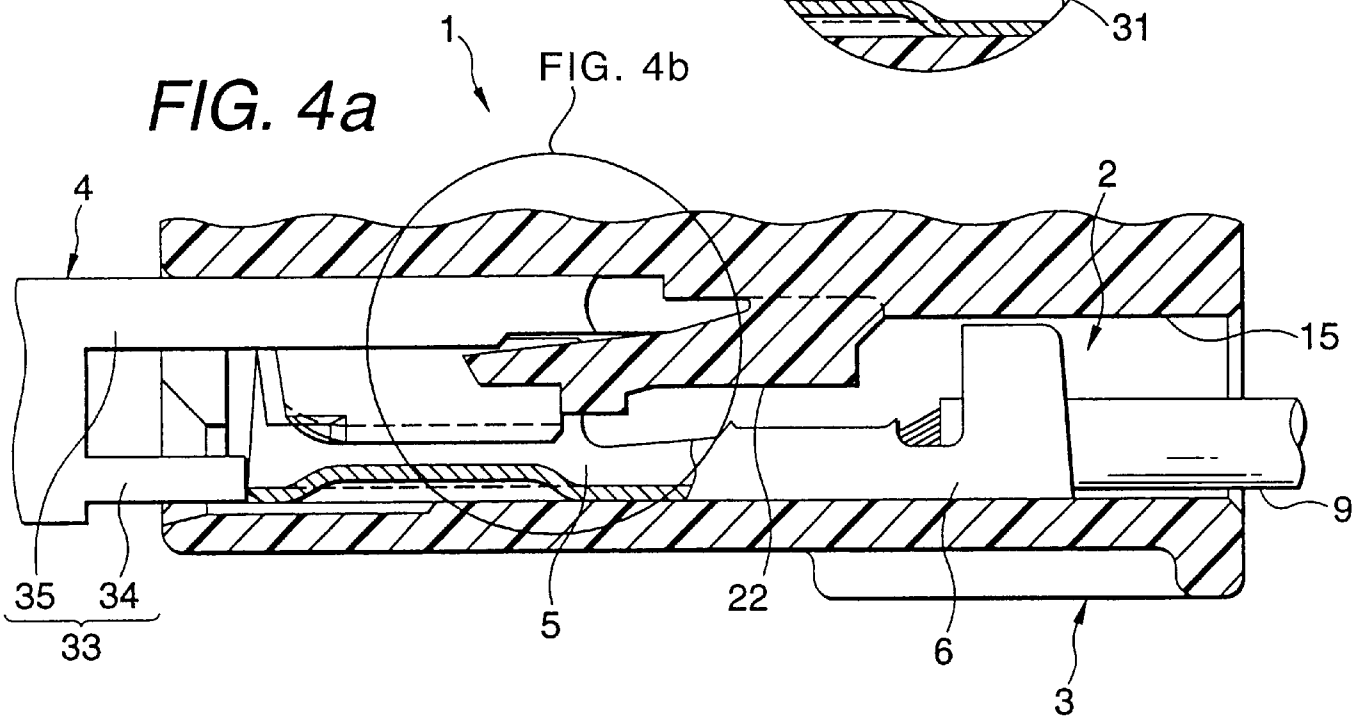

In FIG. 4, when the connector 1 is to be inspected by the connector inspecting instrument 4, the electrical contact pin 34 and the lance displacement detection pin 35 of each inspection pin portion 33 are inserted into the corresponding terminal receiving chamber 15 so as to effect the inspection. In FIG. 4, the connection terminal 2 is completed received in the terminal receiving chamber 15, and therefore the electrical contact pin 34 contacts the connection terminal 2 in electrically-connected relation thereto. Therefore, it is confirmed that the connection terminal 2 is not in a half-insertion condition. Unless the connection terminal 2 is in a half-insertion condition, the lance displacement detection pin 35 will not abut against the lance 22.

Figures 5A, 5B:
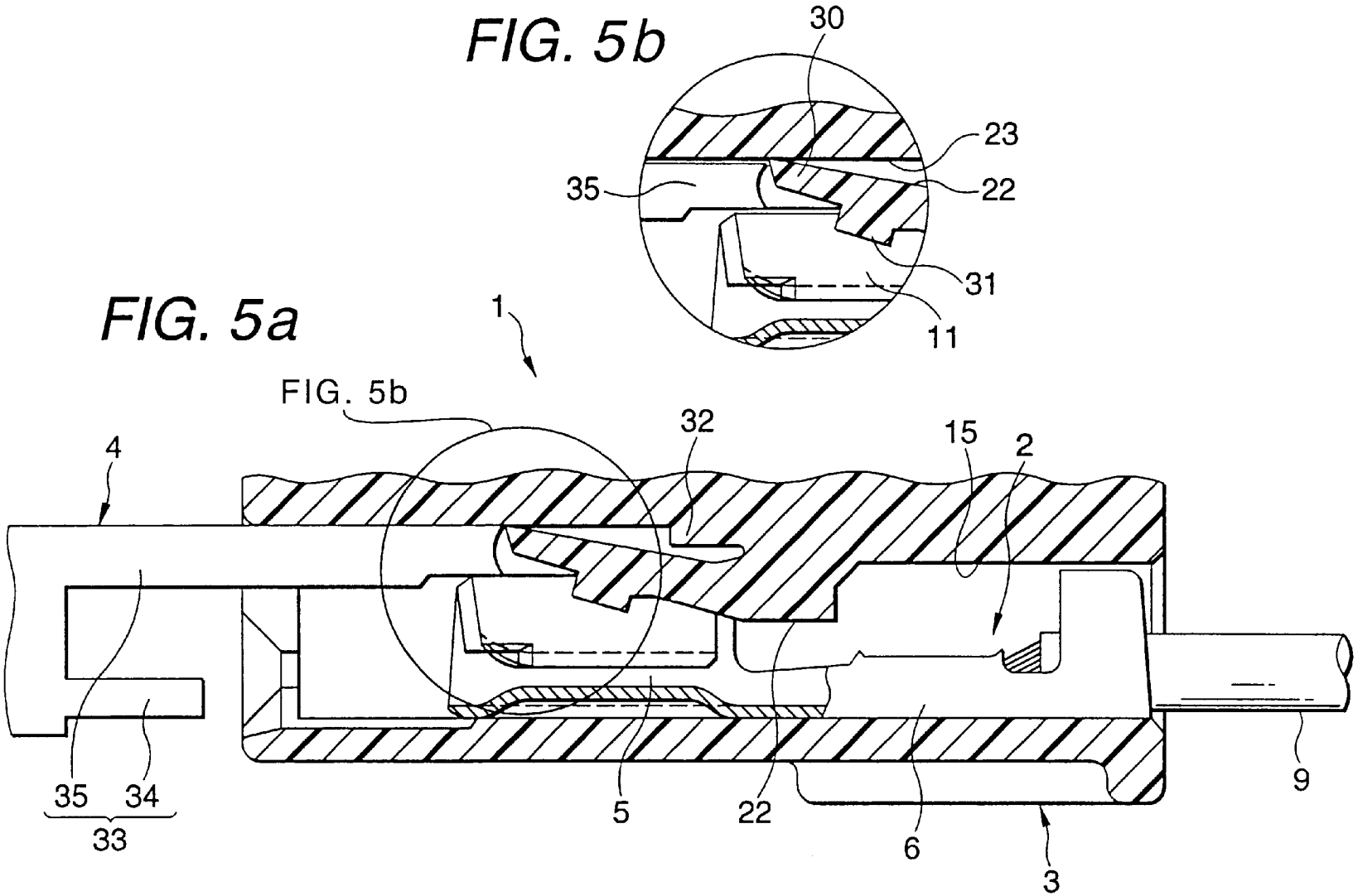
FIGS. 5*a* and 5*b* are cross-sectional views of the connector, showing a condition in which a half-insertion condition of the connection terminal is detected by a lance displacement detection pin of a connector inspecting instrument.

In FIG. 5, when the connection terminal 2 is kept in a half-insertion condition in the terminal receiving chamber 15, the lance displacement detection pin 35 abuts against the distal end portion 30 of the elastically-deformed lance 22. The movement of the inspection pin portion 33 (or the connector 1) is prevented, and the electrical connection of the electrical contact pin 34 to the connection terminal 2 is prevented. Therefore, the half-insertion condition of the connection terminal 2 can be detected.

As described above with reference to FIGS. 1 to 5, the connector 1 has the groove 23 formed in the upper partition wall 16 of the terminal receiving chamber 15, and the lance displacement detection pin 35 of the connector inspecting instrument 4 for detecting a half-insertion condition of the connection terminal 2, as well as the distal end portion 30 of the lance 22, can be inserted into and removed from the groove 23. And besides, the distal end portion 30 is projected longer (as compared with the related construction) in accordance with the depth of the groove 23, and therefore when the connection terminal 2 is received in the terminal receiving chamber 15 in the connector housing 3, so that the lance 22 is elastically deformed by the connection terminal 2, the amount of displacement of the distal end portion 30 of the lance 22 is larger as compared with the related construction. In a half-insertion condition of the connection terminal 2, also, the amount of displacement of the distal end portion 30 of the lance 22 is larger.

When the amount of displacement is thus large, a half-insertion condition of the connection terminal 2 can be positively detected by the connector inspecting instrument 4.

In the connector 1, the height of projecting of the retaining projection 31 on the lance 22 is not larger as compared with the related construction, and therefore the terminal inserting force, required for inserting the connection terminal 2 during the assembling operation, is maintained at the same level as obtained with the related construction.

Therefore, there is achieved the connector in which the distal end portion of the lance can be displaced as much as possible without increasing the terminal inserting force.

Various modifications can be made without departing from the scope of the present invention.

Although not shown in the drawings, the connector can be of such a construction that the terminal receiving chambers 15 are arranged in two (upper and lower) rows, or are juxtaposed in a row.

As described above, in the present invention, the connector comprises the connection terminals, and the connector housing having the terminal receiving chambers for respectively receiving the connection terminals. The lance and the elastic displacement-allowing space are formed within the terminal receiving chamber. The groove is formed in the wall of the terminal receiving chamber which is opposed to the connection terminal, and has the elastic displacement-allowing space formed therein, and the lance displacement detection pin of the connector inspecting instrument for detecting a half-insertion condition of the connection terminal, as well as the distal end portion of the lance, can be inserted into and removed from the groove. The distal end portion of the lance is projected in accordance with the depth of the groove. Therefore, when the connection terminal is received in the terminal receiving chamber in the connector housing, so that the lance is elastically deformed by the connection terminal, the amount of displacement of the distal end portion of the lance is larger as compared with the related construction. In a half-insertion condition of the connection terminal, also, the amount of displacement of the distal end portion of the lance is larger. The lance displacement detection pin of the connector inspecting instrument for detecting a half-insertion condition of the connection terminal can be inserted into the groove.

Therefore, a half-insertion condition of the connection terminal can be positively detected by the connector inspecting instrument.

In the connector, the height of projecting of the retaining projection on the lance is not large, and therefore the terminal inserting force, required for inserting the connection terminal during the assembling operation, is not large.

Therefore, there can be provided the connector in which the distal end portion of the lance can be displaced as much as possible without increasing the terminal inserting force.

In the present invention, the groove for receiving the distal end portion of the lance extends from the insertion port for the lance displacement detection pin to the vicinity of the lance-forming portion on which the proximal end portion of the lance is formed integrally. Therefore, the elastic deformation of the lance is not influenced by the groove, and therefore the lance can maintain its performance.

Therefore, there can be provided the better connector.

In the present invention, the width of the groove is smaller than the width of the elastic displacement-allowing space, and therefore the structure can be simplified.

And besides, the terminal inserting force, required for inserting the connection terminal during the assembling operation, as well as the force of retaining of the connection terminal by the lance, is not affected.

Therefore, there can be provided the better connector.

What is claimed is:

1. A connector and inspecting pin combination, comprising:

a connector housing including a terminal receiving chamber into which a connection terminal is insertable, the connection terminal having a contact portion, and the terminal receiving chamber having a displacement-allowing space;

a lance formed in the terminal receiving chamber, the lance having a distal end portion which extends in an inserting direction of the connection terminal, wherein the connection terminal is inserted into the terminal receiving chamber while pushing the lance so that the distal end portion of the lance is elastically deformed within the displacement-allowing space, such that the connection terminal is retained by the lance in a complete insertion state thereof to prevent the connection terminal from moving in a withdrawing direction opposite to the inserting direction;

a groove extending in the inserting direction of the connection terminal, the groove being formed in a wall of the terminal receiving chamber which is opposed to the connection terminal, wherein the distal end portion of the lance enters the groove in accordance with the insertion of the connection terminal, and wherein length of the distal end portion of the lance is determined in accordance with a depth of the groove, a connector inspecting instrument comprising:

a lance displacement detection pin; and a contact pin, wherein when the connection terminal disposed in the connector housing in a first state, the displacement detection pin abuts against the lance so as not to allow the contact pin to contact the contact portion of the connection terminal, which indicates a half-insertion condition of the connection terminal, and wherein when the connection terminal is disposed in the connector housing in a second state, the displacement detection pin is permitted to be inserted into the connector housing such that the contact pin contacts the contact portion of the connection terminal, which indicates that the connection terminal is not in a half insertion condition.

2. The connector and inspecting pin combination of claim 1, wherein the lance displacement detection pin of the connector inspecting instrument can be inserted along and removed from the groove.

3. The connector and inspecting pin combination of claim 2, wherein the displacement-allowing space is disposed forwardly of a proximal end portion of the lance in the inserting direction of the connection terminal.

4. The connector and inspecting pin combination of claim 3, wherein the groove extends from an insertion port for the lance displacement detection pin to a vicinity of a portion of the wall of the terminal receiving chamber with which the proximal end portion of the lance is integrally formed.

5. The connector and inspecting pin combination of claim 4, wherein a width of the groove in a direction perpendicular to the inserting direction of the connection terminal is smaller than a width of the displacement-allowing space in the same direction as the width of the groove.

6. The connector and inspecting pin combination of claim 1, wherein the lance has a retaining projection which engages the connection terminal to be retained in the terminal receiving chamber, and wherein the distal end portion of the lance is projected from the retaining projection so as to enter the groove in accordance with insertion of the connection terminal.

7. The connector and inspecting pin combination of claim 1, wherein the wall of the terminal receiving chamber has a step shape which forms the groove.

8. The connector and inspecting pin combination of claim 1, wherein the wall, in which the groove is formed, is one of walls of the terminal receiving chamber which define the displacement-allowing space.

9. The connector and inspecting pin combination of claim 1, wherein the displacement-allowing space is disposed forwardly of a proximal end portion of the lance in the inserting direction of the connection terminal.

10. The connector and inspecting pin combination of claim 1, wherein a width of the groove is smaller than a width of the displacement-allowing space, in a direction perpendicular to the insertion direction of the connection terminal.

11. The connector and inspecting pin combination of claim 1, wherein the lance is formed in a cantilever manner with respect to the connector housing to be elastically deformable.

12. The connector and inspecting pin combination of claim 1, wherein the contact pin is electrically conductive, and the contact portion of the connection terminal is electrically conductive, such that when the connection terminal is disposed in the connector housing in the second state, the electrically conductive contact pin contacts the electrically conductive contact portion of the connection terminal to form an electrically conductive relationship therebetween.

13. The connector and inspecting pin combination of claim 12, wherein the contact pin and the displacement detection pin are not electrically connected to each other.

* * * * *